United States Patent [19]

Wrightson

[11] Patent Number: 4,460,520

[45] Date of Patent: Jul. 17, 1984

[54] EVAPORATIVE COOLER WATER SPREADER

[76] Inventor: Robert W. Wrightson, 3 Rothesay Ave., St. Marys, Australia

[21] Appl. No.: 388,110

[22] Filed: Jun. 14, 1982

[30] Foreign Application Priority Data

Jun. 19, 1981 [AU] Australia ..... PE9363

[51] Int. Cl.[3] ..... B01F 3/04

[52] U.S. Cl. ..... 261/106; 62/314; 239/193; 261/29; 261/97; 261/DIG. 3; 261/DIG. 43

[58] Field of Search ..... 261/29, 97, 103, 106, 261/110, 112, DIG. 3, DIG. 4, DIG. 15, DIG. 41, DIG. 43; 62/314–316, 310; D23/141, 145, 146; 239/17, 498, 502, 193, 194

[56] References Cited

U.S. PATENT DOCUMENTS

| | | | |
|---|---|---|---|
| 1,032,657 | 7/1912 | Briggs | 239/193 |
| 1,659,926 | 2/1928 | Stocker | 239/193 |
| 2,522,600 | 9/1950 | Brookins | 239/193 |
| 3,211,380 | 10/1965 | Skerritt | 261/106 X |
| 3,372,911 | 3/1968 | Herboldsheimer | 261/97 X |
| 3,867,486 | 2/1975 | Nagele | 261/DIG. 4 |
| 3,975,470 | 8/1976 | Engel | 261/106 |
| 4,125,576 | 11/1978 | Kozinski | 261/106 |
| 4,158,679 | 6/1979 | Yeagle | 261/106 |
| 4,309,365 | 1/1982 | Van Ness et al. | 261/106 X |
| 4,338,264 | 6/1982 | Seeley | 261/DIG. 4 |

FOREIGN PATENT DOCUMENTS

| | | | |
|---|---|---|---|
| 1034627 | 7/1953 | France | 239/193 |
| 13193 | of 1911 | United Kingdom | 239/193 |

*Primary Examiner*—Richard L. Chiesa
*Attorney, Agent, or Firm*—Jay L. Chaskin

[57] ABSTRACT

A spreader plate having a water receiving area which receives water from a pump, a plurality of ribs radiating outwardly from the central water receiving area, the lengths and spacing of the ribs being such as to divide the water up into a plurality of streams of approximately equal intensity, and a cover over the water receiving area comprising a deflector which deflects water flow over the water receiving area in a constant thickness film and into the channels between the ribs.

8 Claims, 5 Drawing Figures

EVAPORATIVE COOLER WATER SPREADER

This invention relates to a water spreader which is useful in an evaporative cooler of the type having absorbent pads at least partly surrounding a motor driven fan, for the purpose of spreading a flow of water issuing from a pump to percolate down through the absorbent pads.

BACKGROUND OF THE INVENTION

One of the problems which has been encountered heretofore in the spreading of water into absorbent pads has been the tendency for relatively large quantities of water to flow down the shorter conduits and relatively small quantities of water to flow down the longer conduits, and this has resulted in some areas of the absorbent pads having low evaporation rates and others having very high evaporation rates, and, in extreme cases, allowing droplets of water to be drawn into the flow of air. This is very objectionable since it can result in deterioration of soft furnishings.

BRIEF SUMMARY OF THE INVENTION

In this invention a spreader comprises a spreader plate having a water receiving area which receives water from a pump, a plurality of ribs radiating outwardly from the central water receiving area, the lengths and spacing of the ribs being such as to divide the water up into a plurality of streams of approximately equal intensity, and a cover over the water receiving area having a deflector surface which deflects water flow over the water receiving are in a constant thickness film and into the channels between the ribs.

More specifically, the invention consists of a spreader plate having a water receiving area, a plurality of ribs upstanding from the plate and radiating outwardly from the water receiving area and forming between them a plurality of water flow channels, which, in a cooler, terminate above said absorbent pads, the floor of each said water flow channel sloping downwardly from its water receiving area end, a cover over the water receiving area of the spreader plate, having a deflector surface above the water receiving area and having such shape as to deflect water flow over the water receiving area in a constant thickness film, the spacing between adjacent ribs and the lengths of the respective said channels defined thereby being such as to divide said film into streams having equal flow rates.

A problem which sometimes occurs with evaporative coolers is a tendency for water to be drawn in a longitudinal direction along a flange before it runs into the woodwool, or other absorbing material of the pads, and in another aspect of this invention the water extends into the pads by running over a flange surface located above the pads, the flange surface however containing a plurality of spaced grooves which function to inhibit lateral movement of water.

BRIEF DESCRIPTION OF THE DRAWINGS

The embodiment of the invention is described hereunder in some detail with reference to and as illustrated in the accompanying drawings in which.

Figure 1:
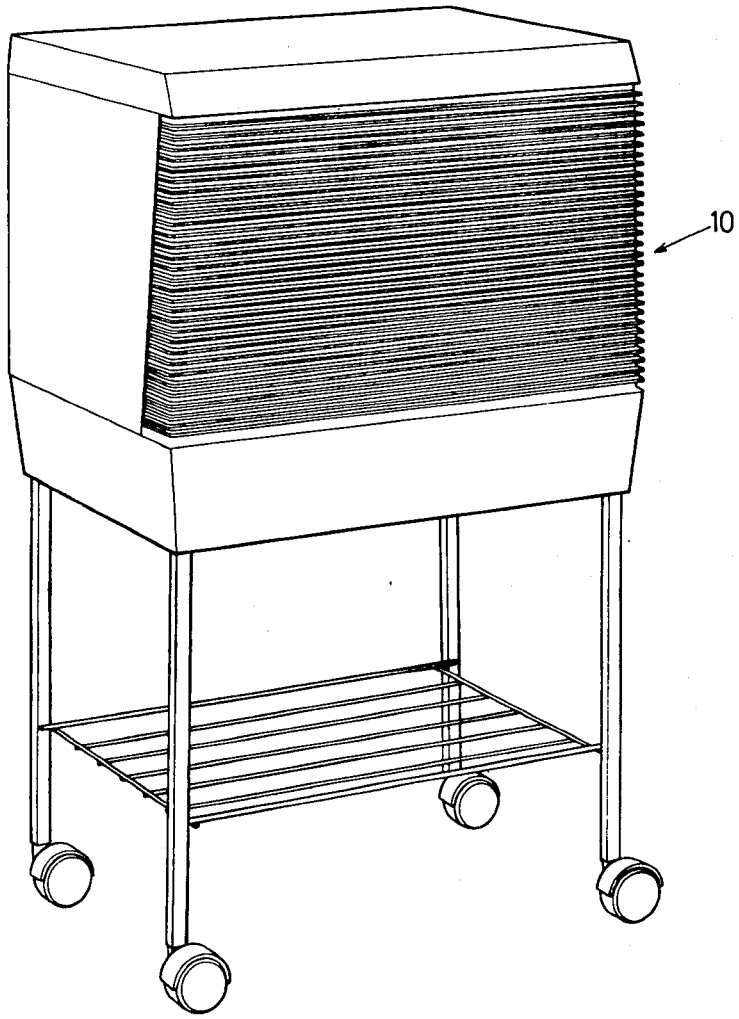
FIG. 1 is a perspective view of an evaporative cooler.
Figure 2:
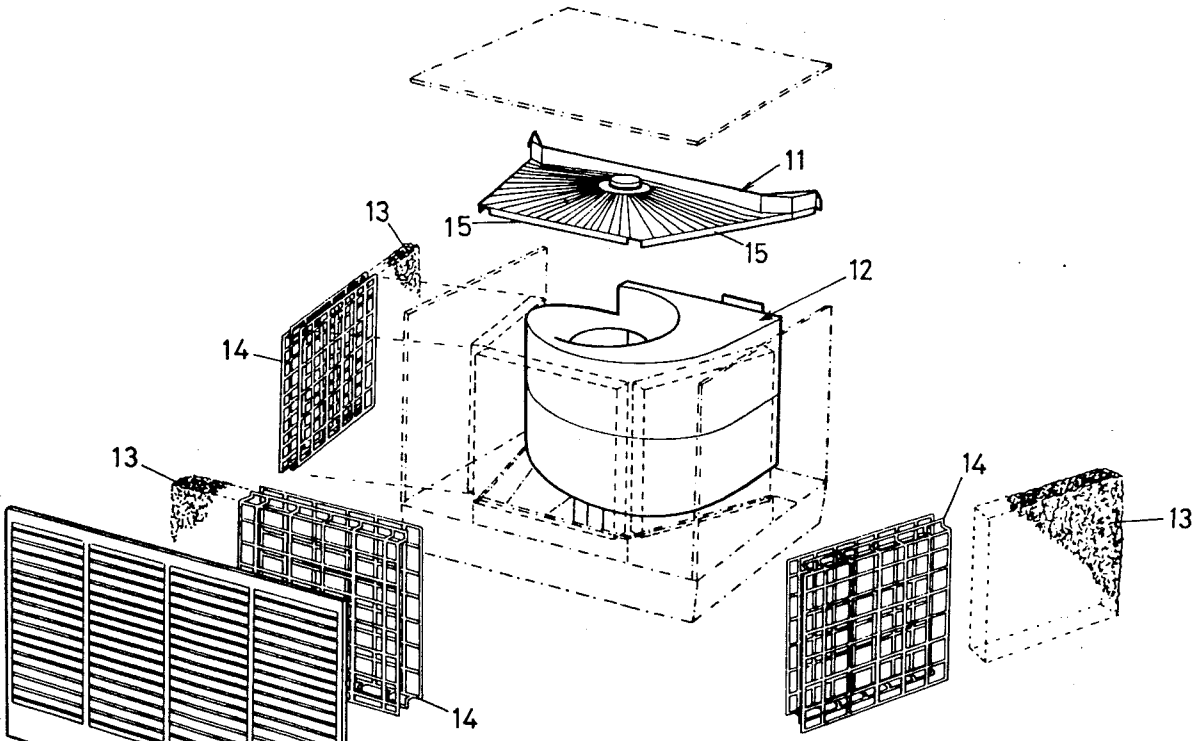
FIG. 2 is an exploded view thereof which illustrates the spreader, absorbent pads and a motor driven fan.

This embodiment refers to an evaporative cooler 10 which is provided with a spreader 11, a motor driven fan 12, and a plurality of absorbent pads 13 retained as shown in FIG. 2 in grid housings 14. These absorbent pads 13, in the assembly of the cooler, underlie peripheral flanges 15 of the spreader 11.

Figure 5:
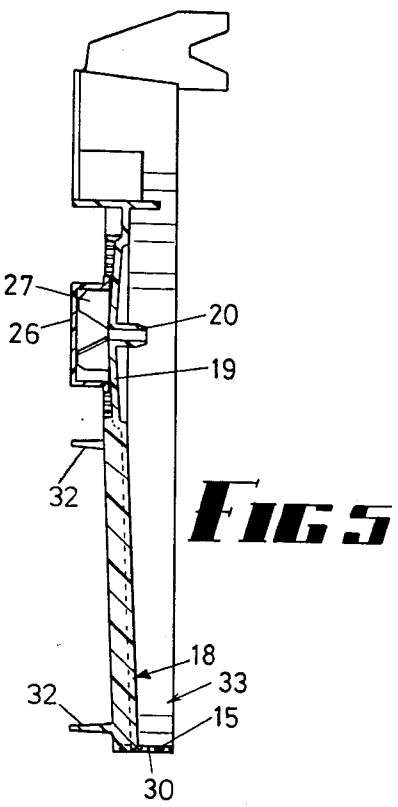
FIG. 5 is a section taken on line 5—5 of FIG. 3.
Figure 3:
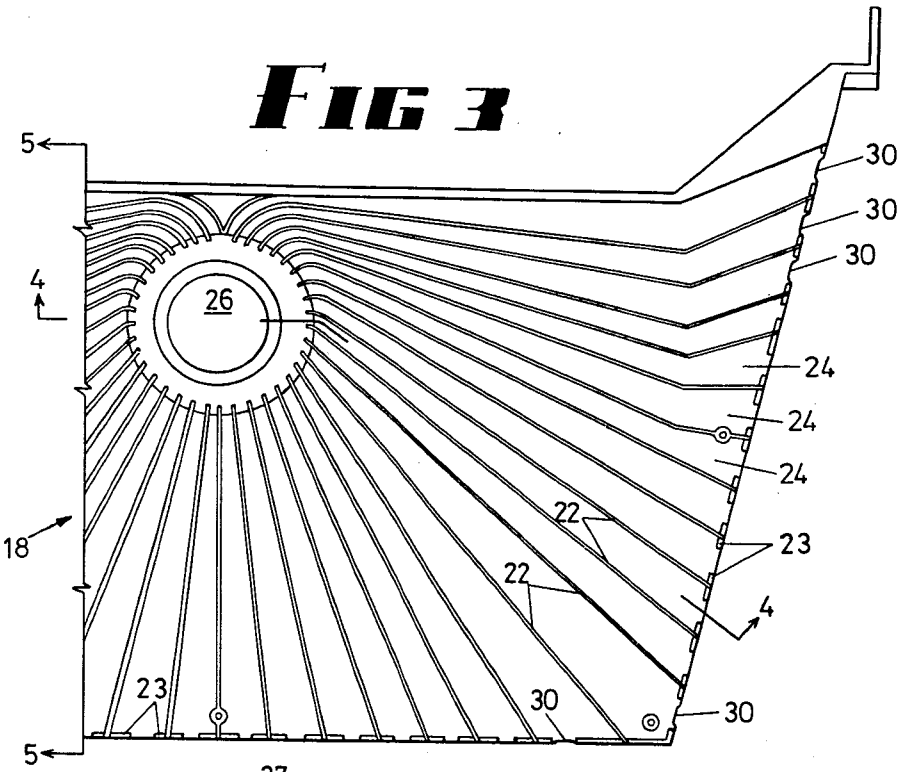
FIG. 3 is a fragmentary plan view of the spreader.
Figure 4:
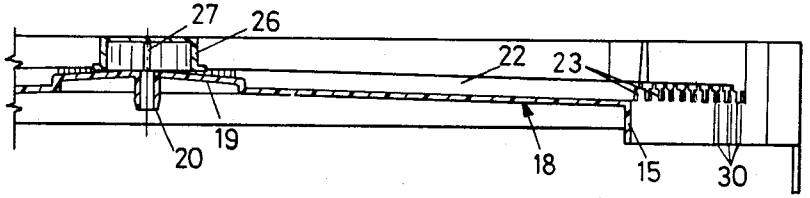
FIG. 4 is a section on line 4—4 of FIG. 3.

Referring now to FIGS. 3, 4 and 5, the spreader 11 comprises a spreader plate 18 which has a conical water receiving area 19 surrounding a hollow tail 20 through which water passes from a pump (not shown) on to the area 19.

The spreader plate 18 is provided with a plurality of upstanding ribs 22 which radiate away from the spreader plate 18 and terminate in discontinuous upstanding flanges 23 (which are extensions of the flanges 15), the discontinuity of the flanges 23 defining water release spaces 24 such that each pair of adjacent ribs 22 defines a respective water flow channel from the water receiving area 19 to the water release spaces 24, the plate 18 sloping downwardly towards the water release spaces 24 so that the floor of each channel thereby slopes.

As will be seen from FIG. 3, the ribs radiate over an area of the plate 18 which exceeds a 180° sector from the tail 20, and in order to deflect water from flowing down the rearmost channels in excessive quantities, the plate is surmounted by a cover 26 supported by three spaced webs 27 which retain the cap in spaced relationship from the water receiving area 19 so that the cover functions as a deflector.

Notwithstanding the cover 26, there can still be some inequality betwen the flow rates of the streams of water which flow down the channels between the adjacent ribs, the longer channels having more flow than the shorter channels, and this is partly compensated for by having different angular spacing between adjacent radiating ribs 22. The arrangement is such that water passing upwardly through the hollow tail flows downwardly over the water receiving area in a constant thickness film and then down the channels in streams having equal flow rates within quite a close degree of tolerance (in this embodiment + or −20%).

Notwithstanding the use of the spaced ribs and the water release spaces 24, it would still be possible under some circumstances for the high air velocity to cause water in droplet form to move along the flanges 15, and to inhibit this each flange 15 is provided with a respective water flow recess 30 beneath at lease some of the water release spaces 24 and these are effective in interrupting lateral movement of water film along the flanges 15.

In order to retain the absorbent pads and the grid housings 14 and the flanges 15 are associated with depending fins 32 as shown in FIG. 5 to provide retention spaces 33 for retaining the upper edges of the three absorbent pads 13 and the water will be seen to discharge over the outer surfaces.

Various modifications in structure and/or function may be made to the disclosed embodiments by one skilled in the art without departing from the scope of the invention as defined by the claims.

What is claimed is:

1. A spreader for the spreading of water in an evaporative cooler of the type having absorbent pads at least partly surrounding a motor driven fan, comprising:

a spreader plate having a water receiving area, a plurality of ribs upstanding from the plate and radiating outwardly from the water receiving area and forming between them a plurality of water flow channels, which, in a cooler, terminate above said absorbent pads, the floor of each said water flow channel sloping downwardly from its water receiving area end, a cover over the water receiving area of the spreader plate, having a deflector surface above the water receiving area and having such shape as to deflect water flow over the water receiving area in a constant thickness film, the lengths of said ribs varying, and the spaces between the water receiving area ends of shorter ribs being less than the spaces between corresponding ends of longer ribs by such an amount that additional resistance to water flow along each of the longer channels is compensated for by a wider entry to that respective said channels such as to divide said film into streams having equal flow rates.

2. A spreader according to claim 1 wherein said deflector surface is the under surface of the cover.

3. A spreader according to claim 1 or claim 2 wherein said spreader plate comprises a hollow water flow tail depending from the apex of a conical portion of the plate which defines said water receiving area.

4. A spreader according to claim 2 wherein the periphery of said spreader plate comprises upstanding flanges to which said ribs extend, each flange being discontinuous intermediate each pair of adjacent ribs to provide a water release space at the end of each respective said water flow channel.

5. A spreader according to claim 4 wherein said flanges also depend from the periphery of said spreader plate, and further comprising fins depending from the under surface of said spreader plate and so spaced from said depending flanges as to form retention means for the retaining of the upper edges of said absorbent pads, when in a cooler.

6. A spreader according to claim 5 wherein a front face of each said flange comprises surfaces defining a plurality of grooves, each groove being located beneath a respective said water release space.

7. A spreader according to claim 6 wherein said flanges also depend from the periphery of said spreader plate; and further comprising fins depending from the under surface of said spreader plate and so spaced from said depending flanges as to form retention means for the retaining of the upper edges of said absorber pads, when in a cooler.

8. A spreader according to claim 1 wherein the periphery of said spreader plate comprises upstanding flanges to which said ribs extend, each flange being discontinuous intermediate each pair of adjacent ribs to provide a water release space at the end of each respective said water flow channel.

* * * * *